United States Patent [19]

Saxer

[11] Patent Number: 4,460,065

[45] Date of Patent: Jul. 17, 1984

[54] ROPE SWAY WARNING DEVICE FOR COMPENSATING ROPES IN ELEVATOR SYSTEMS

[75] Inventor: Albert J. Saxer, Avon, Conn.

[73] Assignee: Otis Elevator Company, Farmington, Conn.

[21] Appl. No.: 410,106

[22] Filed: Aug. 20, 1982

[51] Int. Cl.[3] ..... B66B 5/12

[52] U.S. Cl. ..... 187/29 R; 200/61.44

[58] Field of Search ..... 187/29, 41; 200/61.13, 200/61.18, 61.44, 79, DIG. 26

[56] References Cited

U.S. PATENT DOCUMENTS

| | | | |
|---|---|---|---|
| 647,242 | 4/1900 | Sprague | 187/29 |
| 2,401,150 | 5/1946 | Guy | 187/29 |
| 3,791,490 | 2/1974 | Smith | 187/29 |
| 4,106,594 | 8/1978 | Kirsch et al. | 187/29 |

FOREIGN PATENT DOCUMENTS

| | | | |
|---|---|---|---|
| 897682 | 1/1982 | U.S.S.R. | 187/29 |

*Primary Examiner*—G. Z. Rubinson
*Assistant Examiner*—W. E. Duncanson, Jr.
*Attorney, Agent, or Firm*—Robert E. Greenstien

[57] ABSTRACT

A device is attached to the compensating rope sheave assembly in an elevator system to detect rope sway exceeding a certain magnitude. The device includes a switch which is attached to the assembly and a loop which is positioned around the rope. The loop is attached to a movable member of the switch. When the rope sways and contacts the loop, it actuates the switch. The loop can be opened to place it around the rope, and it is made of pliant material to protect the switch and the rope.

6 Claims, 3 Drawing Figures

ROPE SWAY WARNING DEVICE FOR COMPENSATING ROPES IN ELEVATOR SYSTEMS

DESCRIPTION

Technical Field

This invention pertains to devices for detecting rope sway in the compensating ropes in an elevator system.

Background Art

In an elevator system one or more ropes extend from the bottom of the elevator car to a compensating sheave assembly (located at the bottom of the hoistway) and then up to the counterweight. Those ropes are intended to compensate for the weight of the ropes extending from the top of the counterweight to the car so that the ratio between the weight of the counterweight and the fully loaded cab is the same regardless of the location of the car in the hoistway.

When the elevator car is at the uppermost portion in its travel, the compensating ropes extend the length of the hoistway, and in large buildings the length is considerate. If the building is swaying, which may happen under high wind conditions, the compensating ropes may start to sway in an oscillating manner. When this happens, the ropes may jump out of the sheave groove as the sheave rotates.

Disclosure of Invention

According to the present invention, a rope sway detection device is located on the compensating sheave housing. This device consists of, for each compensating rope, a ring through which the compensating rope extends, and this ring is part of an arm which is attached to a microswitch, which is attached to the housing. If the ropes should start to sway, it will contact one of these rings and displace, actuating the switch. The switch is electrically connected to the elevator motion control system, and upon actuation by the switch commands the system to operate in an altered mode.

The invention thus provides a very simple, yet reliable, device for altering elevator system operation when the ropes begin to move beyond a predetermined range, as defined by the size and location of the loops through which they extend. A feature of the invention is that the device may be easily retrofitted into existing systems.

BRIEF DESCRIPTION OF DRAWINGS

FIG. 2 shows the position of the ropes when there is no sway; FIG. 3 when there is.

BEST MODE FOR CARRYING OUT THE INVENTION

Figure 1:
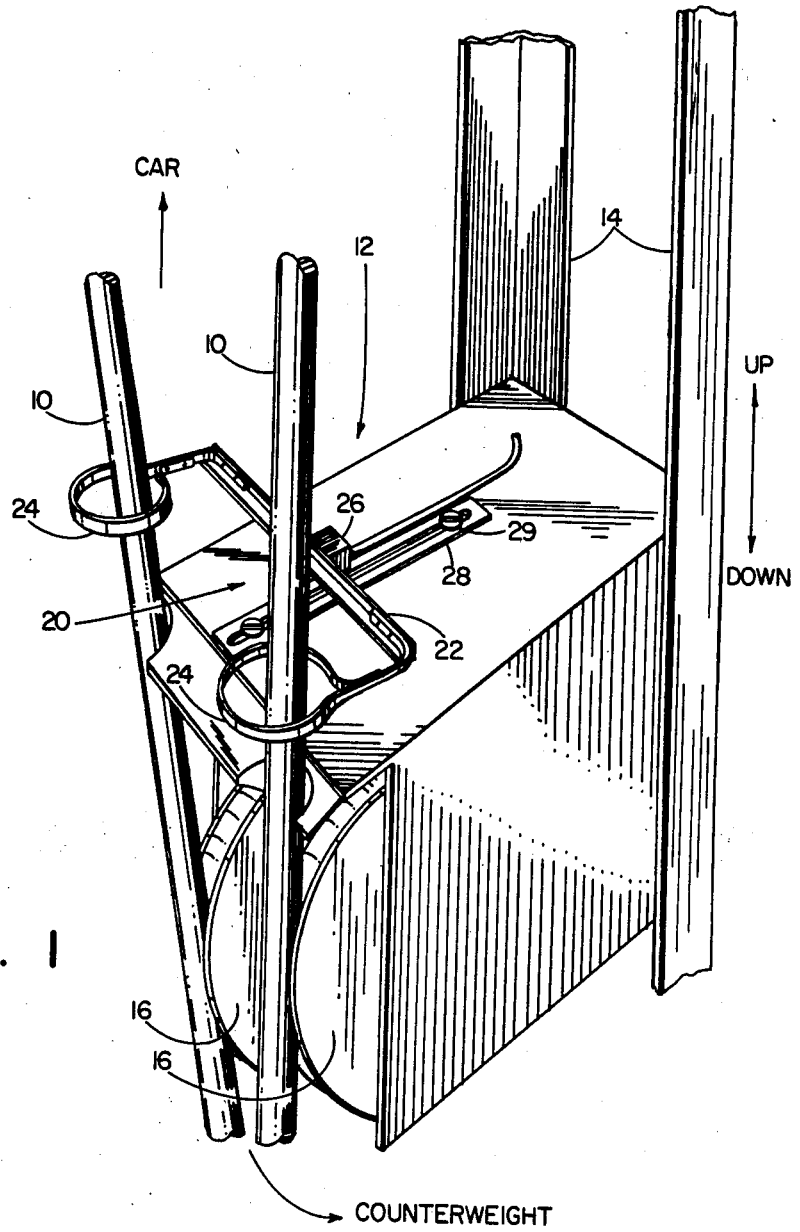
FIG. 1 is a perspective view of a typical two-rope compensating sheave, including a detection, according to the present invention.

In FIG. 1 a pair of compensating ropes 10 are partially shown. This pair of ropes extend down from the elevator car through a compensating rope sheave housing or assembly 12, which is mounted on tracks 14 so that the housing may slide up and down. The housing can slide up and down on this track in order to tension the compensating ropes, and, normally, a safety (not shown) is used to prevent excessive velocities. The compensating ropes extend around the round sheaves

16 and through the bottom of the housing and then to the counterweight.

On the top of the housing is a device 20, which includes an arm 22 to which two loops 24 are attached. Each of these loops encircles a compensating rope 10, and by removing the fasteners **24*a* each loop can be opened to position the loop around the rope. The arm is connected to a movable member (actuator pin) 25 of a microswitch (low force switch) 26, and the switch's stationary portion 27 (see FIGS. 2 and 3) is fixed to the top of the housing. The switch is thus sensitive to movement of the arm back and forth in the horizontal plane, which happens when the rope 10** sways enough to push on the loop.

The stationary portion 27 is attached to a slotted track 28 on which it may be moved or stopped to position the loop properly around the rope. The track is attached to the assembly by bolts 29.

Figure 2:
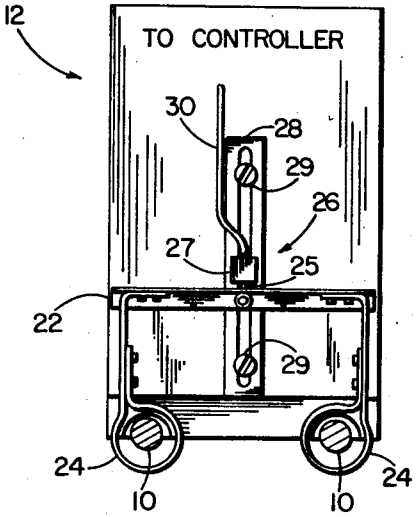

FIG. 2 shows the position of each compensating rope 10 in a loop during normal position, when there is no rope sway. Each rope is in the center of the loop.

Figure 3:
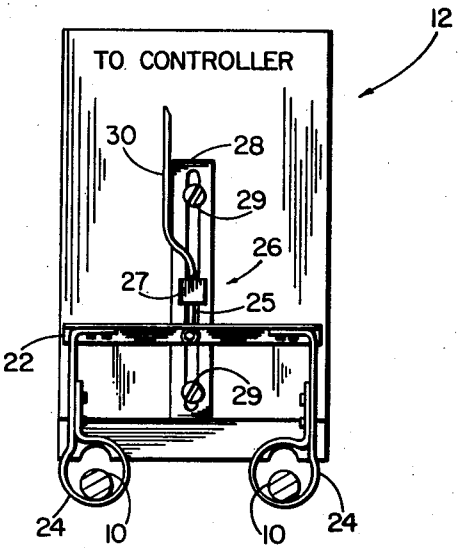
FIGS. 2 and 3 are plan views of the detection device.

FIG. 3, on the other hand, shows the ropes contacting the loops, which happens when there is sway. That motion pulls the arm horizontally, and the switch is thus actuated. When the switch is actuated, a signal is provided over a line 30 that connects with a system controller, thus providing an indication that the cables have swayed too far in one direction. When the signal appears, the controller system may alter the system's operation. For instance, the controller may bring the car at safety speed to the next floor (if the car is moving) or prevent the car from moving (if it is stopped).

The arm 22 may be constructed simply of an L-bracket. The loop can be made of aluminum. Aluminum makes the loops pliant and soft. A loop with those characteristics minimizes rope damage when the rope contacts the loop. It also makes it easy to bend the loop back into shape should it be bent when hit by the rope. Also, by being pliant, the loop absorbs shocks and blows from the rope, thus protecting the switch.

The loops may be bolted or riveted to the bracket. Their diameter is selected to represent the range outside of which unacceptable rope movement exists (the maximum rope sway distance that can be tolerated). The loops and the switches can be attached, as shown in FIGS. 2 and 3, to a slotted track 29, so that the position of the loops relative to the ropes can be adjusted to position each rope in the loop center.

The invention, it can be observed, provides a very simple, inexpensive, yet highly reliable device for detecting unacceptable displacements of the compensating ropes and for correcting system operation accordingly. The device can be easily installed as a retrofit in existing systems.

Other modifications, alterations, variations and changes to the present invention will be apparent, without departing from its true scope and spirit.

I claim:

1. A compensating rope sway detection apparatus for attachment on a compensating rope sheave assembly in an elevator system and for electrical connection with the elevator system controller, characterized by:

a switch for providing an electrical connection to the controller, said switch having a movable switch actuating member and a stationary member, a bracket to which the stationary member is attached for attaching the switch to the rope sheave assembly, the position of the switch on said bracket being adjustable, and a loop which is attached to the movable member for encircling the rope, said loop being adapted to be opened to place the rope therein.

2. A compensating rope sway detection apparatus as described by claim 1, characterized by:

said bracket having a slot in which the stationary switch member can slide for adjusting the position of the loop around the rope.

3. A compensating rope sway detection apparatus as described by claim 1, characterized by said loop being made of soft, pliant material.

4. An elevator system having a system controller, compensating rope and a compensating rope sheave assembly, characterized by a rope sway detection apparatus comprising:

a switch for providing an electrical connection to the controller, said switch having a movable switch actuating member and a stationary member, a bracket to which the stationary member is attached, said bracket being attached to the rope sheave assembly, and the position of the switch on said bracket being adjustable, and a loop which is attached to the movable member, said loop encircling the rope and being adapted to be opened to place the rope therein.

5. An elevator system according to claim 4, characterized by said loop extending around a section of the compensating rope that extends from the sheave assembly to the car.

6. A elevator system according to claims 4 or 5, characterized by said loop being made of a soft, pliant material.

* * * * *